US008012047B2

(12) United States Patent
Gamboa

(10) Patent No.: US 8,012,047 B2
(45) Date of Patent: Sep. 6, 2011

(54) FOOTBALL PASS RECEIVING TRAINER

(75) Inventor: Ricardo Gamboa, Monterey Park, CA (US)

(73) Assignee: BORG Unlimited Inc., Monterey Park, CA (US)

( * ) Notice: Subject to any disclaimer, the term of this patent is extended or adjusted under 35 U.S.C. 154(b) by 57 days.

(21) Appl. No.: 12/436,248

(22) Filed: May 6, 2009

(65) Prior Publication Data

US 2009/0305825 A1 Dec. 10, 2009

Related U.S. Application Data

(60) Provisional application No. 61/060,005, filed on Jun. 9, 2008.

(51) Int. Cl.
*A63B 69/34* (2006.01)
*A63B 67/00* (2006.01)
*A63B 69/00* (2006.01)

(52) U.S. Cl. ..... 473/442; 473/445; 473/438; 473/441

(58) Field of Classification Search ..... 473/422, 473/438, 441–443, 445; 482/83–90
See application file for complete search history.

(56) References Cited

U.S. PATENT DOCUMENTS

| | | | | | |
|---|---|---|---|---|---|
| 299,091 | A * | 5/1884 | Rumsy | 482/89 |
| 318,766 | A * | 5/1885 | Longden | 473/442 |
| 341,231 | A * | 5/1886 | Goodman | 482/90 |
| 426,944 | A * | 4/1890 | Lovatt | 482/89 |
| 770,869 | A * | 9/1904 | Roe | 482/89 |
| 1,917,208 | A * | 7/1933 | Maddock | 473/442 |
| 2,045,972 | A * | 6/1936 | Tompkins | 482/89 |
| 2,088,861 | A * | 8/1937 | Klum | 473/442 |
| 2,696,383 | A * | 12/1954 | Noftsinger | 473/441 |
| 3,337,217 | A * | 8/1967 | Cummins | 473/442 |
| 3,390,880 | A * | 7/1968 | Forrest | 473/441 |
| 3,889,948 | A * | 6/1975 | Visco | 473/441 |
| 4,534,557 | A * | 8/1985 | Bigelow et al. | 473/442 |
| 4,721,302 | A * | 1/1988 | Murphy | 482/89 |
| 4,749,185 | A * | 6/1988 | Spears | 482/89 |
| 5,340,101 | A * | 8/1994 | Lawson et al. | 473/426 |
| 5,458,326 | A * | 10/1995 | Marcyes | 473/426 |
| 5,554,088 | A * | 9/1996 | Zlojutro | 482/83 |
| 5,662,537 | A * | 9/1997 | Zuber | 473/426 |
| 5,674,751 | A * | 10/1997 | Jaduszliwer et al. | 436/116 |
| 5,702,327 | A * | 12/1997 | Fullbright | 482/83 |
| 5,766,102 | A * | 6/1998 | Lawson et al. | 473/428 |
| 5,989,137 | A * | 11/1999 | Krueger | 473/423 |
| 6,261,210 | B1 * | 7/2001 | Lishejkov et al. | 482/83 |
| 6,461,281 | B2 * | 10/2002 | Bouvier | 482/86 |
| D606,136 | S * | 12/2009 | Gamboa | D21/719 |
| 2004/0110607 | A1 * | 6/2004 | Crespo | 482/89 |
| 2010/0093503 | A1 * | 4/2010 | Commeau | 482/87 |

* cited by examiner

*Primary Examiner* — Mitra Aryanpour
(74) *Attorney, Agent, or Firm* — Kelly Lowry & Kelley, LLP

(57) ABSTRACT

The football pass receiving trainer includes a cord extending between a first support and a second support and includes a pad selectively positionable along the length of the cord, wherein the pad is sized so a receiver must catch a football around the pad with the hands and extended arms and elbows. The cord stretches upon contact with the foam pad and is selectively tensioned between the first support and the second support. The football pass receiving trainer is usable as a stand-alone unit via a free-standing base and plurality of slidingly engageable feet or through use of a hook and stabilizing cord that cooperate to selectively secure the support to the chain link fence.

9 Claims, 5 Drawing Sheets

10
48
44
16
46
18
3
38
40
42
28
14
34
32
36a
36b
36c
30
26
12
24
20
22
50
52

FOOTBALL PASS RECEIVING TRAINER

BACKGROUND OF THE INVENTION

The present invention generally relates to a football pass receiving trainer. More particularly, the present invention relates to a football pass receiving trainer that forces a receiver to catch a football with the hands and extended arms.

Professional football has evolved into a multi-billion dollar business industry through advertising, merchandising and television contracts. With such increased growth in the industry in recent years, players are now, more than ever, competing among one another for lucrative multi-million dollar contracts. Thus, the demand for performance enhancement football training tools has grown dramatically.

There are two aspects that are important to a football offense: (1) the running game; and (2) the passing game. To be two-dimensional, a football team must have offensive players capable of running and passing. Importantly, wide receivers, running backs, tight ends, and even quarterbacks (collectively "receivers"), must learn proper football catching techniques to be able to catch forward, lateral, and shovel passes efficiently and consistently. One difficult aspect of training football players is teaching the correct handling and/or football catching techniques that allow the receivers to track the motion of the football, quickly react to unexpected football deflections, and catch the football.

Football passes may be difficult to catch when the correct techniques are not employed. One problem associated with harnessing football reception skills involves correct positioning of the hands. Receivers tend to catch the football with the body and thereafter wrap their arms around the ball. Preferably, receivers should catch the football with the hands. Receiving a football with the hands, instead of the body, increases the percentage of passes caught by the receiver and enables the receiver to more quickly respond to unexpected changes to the football trajectory. Thus, correct hand placement by the receiver prior to catching the football is pivotal to improving catching abilities.

Football players are typically taught how to properly catch a football. A well-thrown football (e.g. a "spiral") rotates about its major axis and is typically caught with the hands in one of two major catching positions: (1) above the waist—positioning the hands with the palms facing toward the ball and with the index fingers and thumbs touching or in close proximity of one another to produce a "diamond" shape; or (2) below the waist—positioning the spread open hands with palms facing toward the ball and with the little fingers just touching each other to produce a "w" shape. U.S. Pat. No. 6,006,358 to Keating discloses a set of football catch training gloves that teach proper positioning of the fingers to catch the football in this regard. The gloves have a set of hook and loop fasteners that interconnect elastic sections extending laterally between the gloves. The interconnected gloves place the hands of the receiver in the "diamond" position when catching the football above the waist. Alternatively, the gloves may be configured to place the hands of the receiver in an inverted "w" position for catching the football below the waist. The gloves are intended to train and enhance the ability of a receiver to catch a football.

There are a number of training techniques and devices designed to enhance football reception and football handling. One simple technique is a practice drill involving three players. The first player (quarterback) throws the football to a second player (receiver) that is guarded by a third player (defenseman). The defenseman actively attempts to prevent successful pass completion of the football from the quarterback to the receiver. The defenseman may try to impair the vision of the receiver, attempt to intercept the football, or otherwise deflect or knock the football down to prevent a successful reception by the receiver. The receiver must learn how to track the football through the air despite being covered by the defenseman. The receiver must also learn how to properly react and adjust to the defenseman and any change in the trajectory of the football when the defenseman deflects the football. Often football teams run a "tip drill" where players work on hand-eye coordination of deflected or tipped passes.

One major drawback with this technique is that the drill does not teach the receiver the correct positioning of the hands when receiving the football. Another drawback is that the quarterback and receiver must be able to complete the pass to enhance the pass reception ability of the receiver. Moreover, a live defenseman does not necessarily improve the ability of the receiver to catch the football. It is often difficult to replicate game-time actions as defensemen are often off-balance and frequently lunge or rush the receiver to prevent pass completion. Defensemen may only slightly deflect passes by grazing the football while in flight. Regardless, the receiver still needs to work on pass reception skills and ball handling.

Another drawback to practicing pass receptions is that the receiver may develop poor habits during training when failing to properly catch the football. Specifically, the football receivers should not allow the elbows to come too close to the body when endeavoring to catch a football. The range of catching motion is sacrificed when the arms move too close to the body. Such restriction also interferes with proper receiving mechanics. Moreover, catching techniques are enhanced when the receivers are able to keep the elbows away from the body while receiving the football. Catching the ball with outstretched arms gives the receiver a large range motion and a faster response time to react to various situations in the game.

Proper hand positioning to receive a football is not natural and coaching instructions are not easily followed during training or practice exercises without a training device. Thus, there have been several football pass catching trainer aids developed to train players to catch a pass. Receivers are often taught to catch the football with the fingers/fingertips rather than with the palms. Such a technique enables a receiver to extend the vertical and lateral reach for receiving passes while simultaneously improving dexterity. But, the prior art does not address the common problem of correcting the tendency for receivers to allow the arms and elbows to move too close to the torso such that the receiver catches the football with the body rather than with the hands and with arms positioned away from the body. Catching the football with outstretched hands and arms enables the receiver to more efficiently move, thereby decreasing the time the defenseman can defend the pass.

Thus, there exists a significant need in the art for a football pass receiving trainer. Such a football pass receiving trainer should include an adjustable foam pad, should be adjustable in height, should be versatile for freestanding use or attachment to a chain link fence and should, during use, reinforce basic receiver skills and hand-eye coordination associated with receiving a football. The present invention fulfills these needs and provides further related advantages.

SUMMARY OF THE INVENTION

The football pass receiving trainer disclosed herein includes a cord extending between a first support and a second support and a pad selectively positionable along the length of the cord. The pad is sized so a receiver must catch a football around the pad with the hands and extended arms and elbows. The cord is preferably manufactured out an elastic material such as a bungee cord, a nylon cord, a cotton cord or another synthetic cord capable of stretching under tension. The cord is selectively tensioned between the first support and the second support and designed to stretch when a receiver contacts the pad. Accordingly, the cord should return to a normal tensioned size after being stretched by the receiver. Tensioning the cord between the first support and the second support may be accomplished through use of a hook and loop, a snap, a clip, a weight or a ground stake. The pad itself is preferably manufactured out of an absorbent foam material that provides non-injurious impact to a receiver endeavoring to receive the football, even without pads. Moreover, the football pass receiving trainer may include an arm coupled to the first support. In this embodiment, the cord extends from the arm instead of the first support. The arm may include a flexible bow or an extension beam. The first support and the arm are also selectively extendable and may be positioned in an extended position or a retracted position by a lock.

In one alternative embodiment of the football pass receiving trainer, a free-standing base selectively engages with the first support. The free-standing base enables the football pass receiving trainer to stand upright. Accordingly, the free-standing base provides portability for the football pass receiving trainer for use in any one of a number of environments, such as a football field. Moreover, the football pass receiving trainer may include a plurality of feet that slidingly engage with the base to provide further support. The feet may be removed to compactly transport the football pass receiving trainer between locations.

In another alternative embodiment, the football pass receiving trainer includes a hook associated with the first support for selectively engaging a link on a chain link fence. In this embodiment, the football pass receiving trainer also includes a stabilizing cord coupled to the first support and selectively engageable with another link on the fence. Accordingly, the stabilizing cord and the hook cooperate to selectively secure the first support to the fence. A stabilizing panel associated with the first support and selectively positionable between retracted and extended positions may also be integrated into the football pass receiving trainer to prevent rotation of the football pass receiving trainer when attached to the chain link fence.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
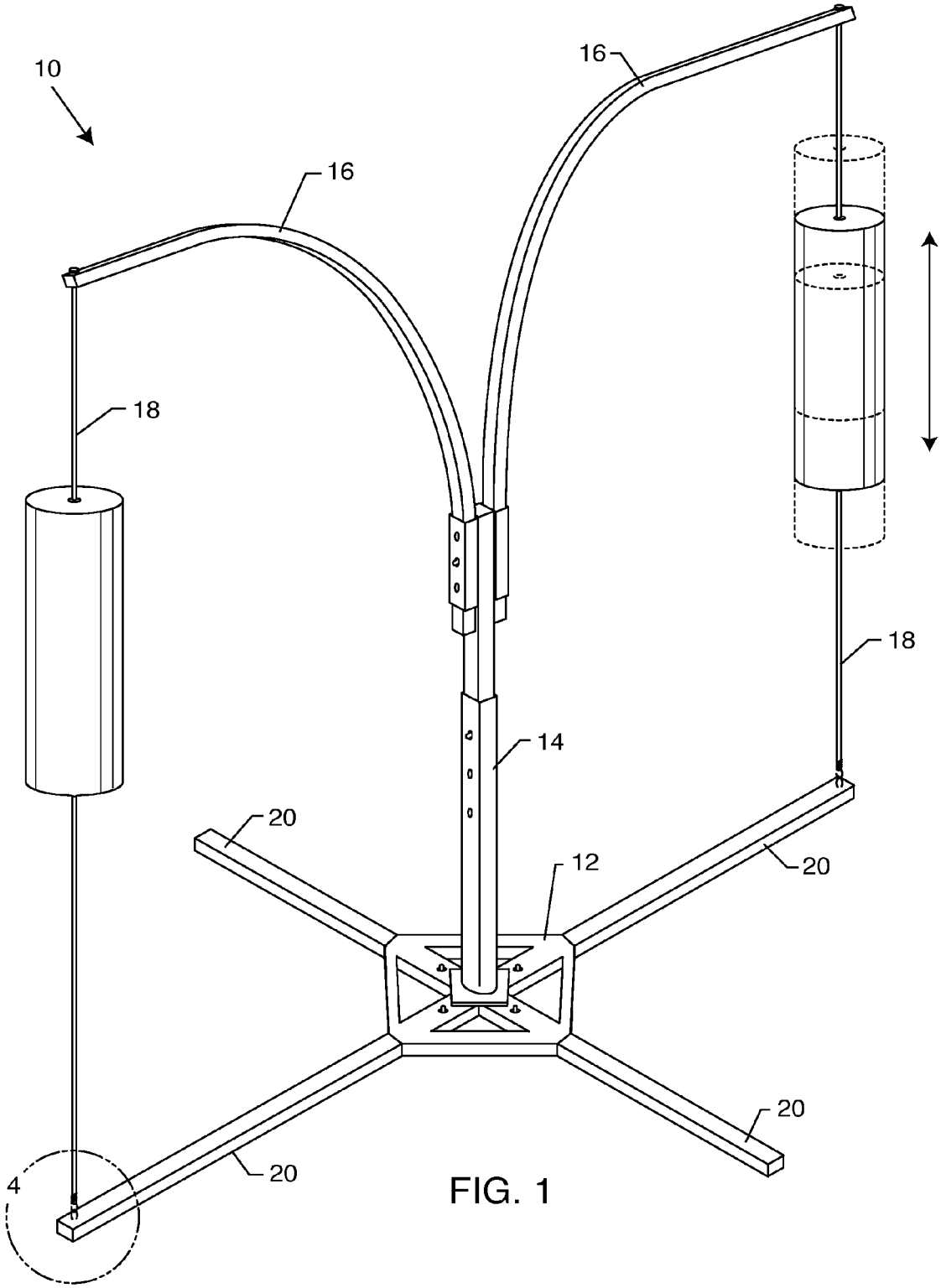
FIG. 1 is a perspective view of one embodiment of a football pass receiving trainer.
Figures 2, 3, 4:
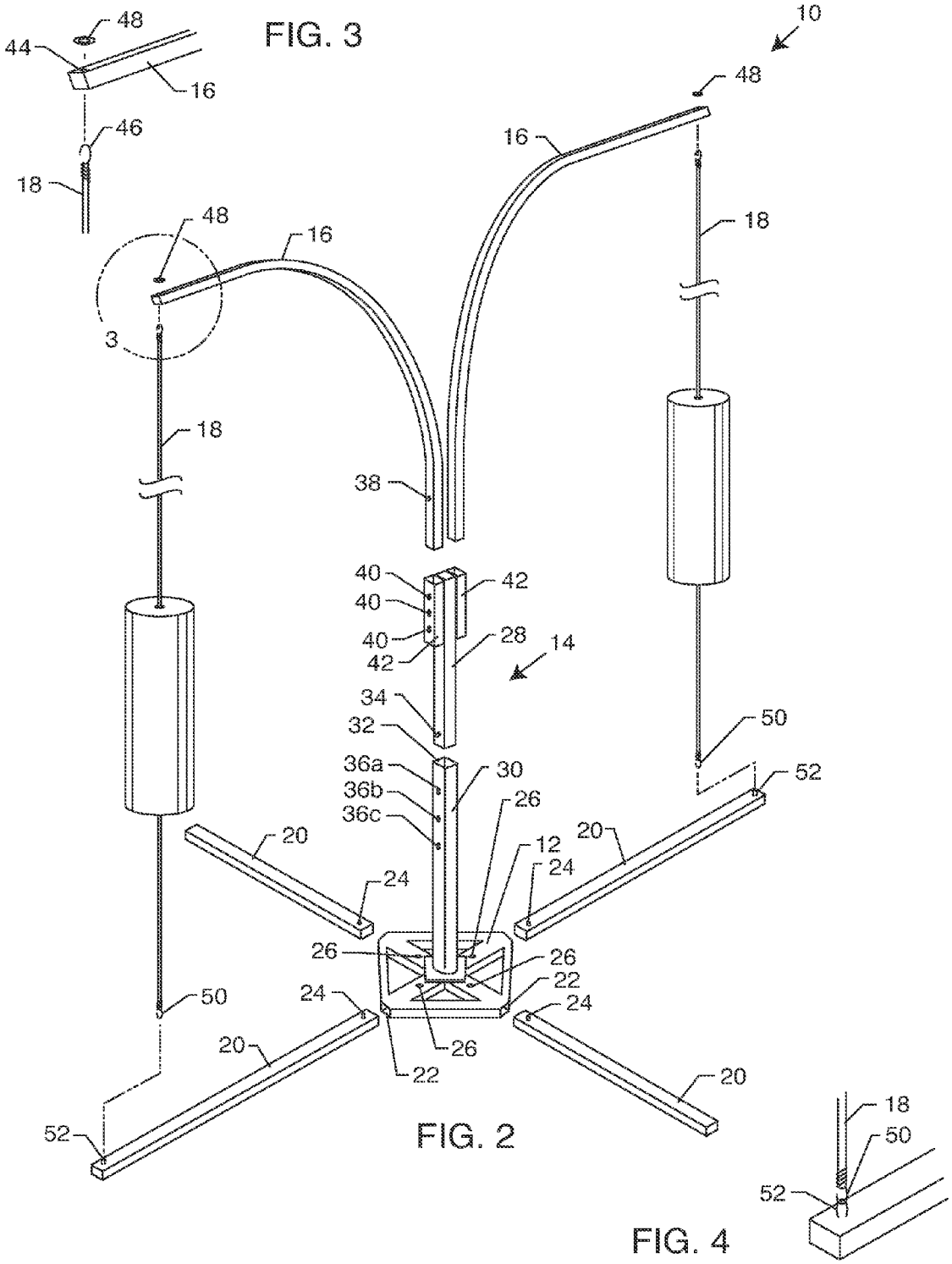
FIG. 2 is an exploded perspective view of the football pass receiving trainer of FIG. 1.
FIG. 3 is an enlarged perspective view taken about the circle 3 in FIG. 2, illustrating attachment of a cord to a bow of the football pass receiving trainer.
FIG. 4 is an enlarged perspective view taken about the circle 4 in FIG. 1, illustrating attachment of the cord to a base of the football pass receiving trainer.

As shown in the drawings for purposes of illustration, the present invention for a football pass receiving trainer is referred to generally by the reference number 10. In FIG. 1, the football pass receiving trainer 10 is shown having a base 12, a stem 14 and a pair of bows 16 attached to the stem 14. A pair cords 18 interconnect the bows 16 with any one of a number of feet 20 attached to the base 12. Each of the feet 20 telescopingly engage a channel 22 formed in the base 12 as shown in FIG. 2. The feet 20 securely lock to the base 12 via a depressible button 24 that engages a corresponding aperture 26 aligned with the depressible button 24 within the channel 22. Accordingly, the depressible button 24 is compressed into the interior of the feet 20 for sliding engagement with the corresponding channel 22. The feet 20 slide toward the interior of the base 12 until the depressible button 24 aligns with the aperture 26. Once aligned, the depressible button 24 extends up into and locks with the aperture 26 to prevent movement of the feet 20 relative to the base 12. Removal of the feet 20 from the base 12 is accomplished by again depressing the depressible button 24 from within the aperture 26 to enable the feet 20 to move within the respective channel 22. Accordingly, the feet 20 are used to balance the football pass receiving trainer 10 in the upright position illustrated in FIG. 1. Preferably the base 12 and the feet 20 are manufactured from a substantially rigid material such as metal, aluminum, a metal alloy or other strong plastic material. Of course, the feet 20 disconnect from the base 12 to enhance the portability of the football pass receiving trainer 10 disclosed herein.

FIG. 2 illustrates the stem 14 comprising an upper portion 28 and a lower portion 30. The lower portion 30 is rigidly attached to the base 12. The upper portion 28 of the stem 14 slidingly engages a channel 32 for adjustable engagement to the lower portion 30. Similar to the engagement of the feet 20 with the base 12, the upper portion 28 includes a depressible button 34 that aligns with a plurality of apertures **36*a*-36*c* formed along the length of the lower portion 30 of the stem 14. The depressible button 34 is compressed such that the upper portion 28 can slide into the channel 32 of the lower portion 30. Upon initial setup, the depressible button 34 will extend into and engage the aperture 36*a*. The height of the stem 14 may be adjusted by depressing the button 34 such that the upper portion 28 may again slide within the channel 32. To reduce the overall height of the stem 14, a user would interlock the depressible button 34 with any of the other two apertures 36*b*, 36*c*. Thus, the football pass receiving trainer 10 may be adjusted according to the height of the receiver using the trainer 10. The upper portion 28 may also be completely removed from within the channel 32 of the lower portion 30 to increase the compactability of the football pass receiving trainer 10** for storage or transportation.

The bows 16 attach to the upper portion 28 with a similar depressible button 38 (only one shown). The depressible button 38 may engage any one of a plurality of apertures 40 formed in a pair of channels 42 on opposite sides of the upper portion 28 of the stem 14. The channels 42 allow sliding engagement of the bows 16 therein and interlock via a similar depressible button 38 and apertures 40, as described above. Like the stem 14, the bows 16 are adjustable in height relative to the upper portion 28 via any one of a number of apertures 40. The bows 16 are likewise completely detachable from the upper portion 28 of the stem 14 for purposes of collapsing the football pass receiving trainer 10 for storage or transportation.

Figure 5:
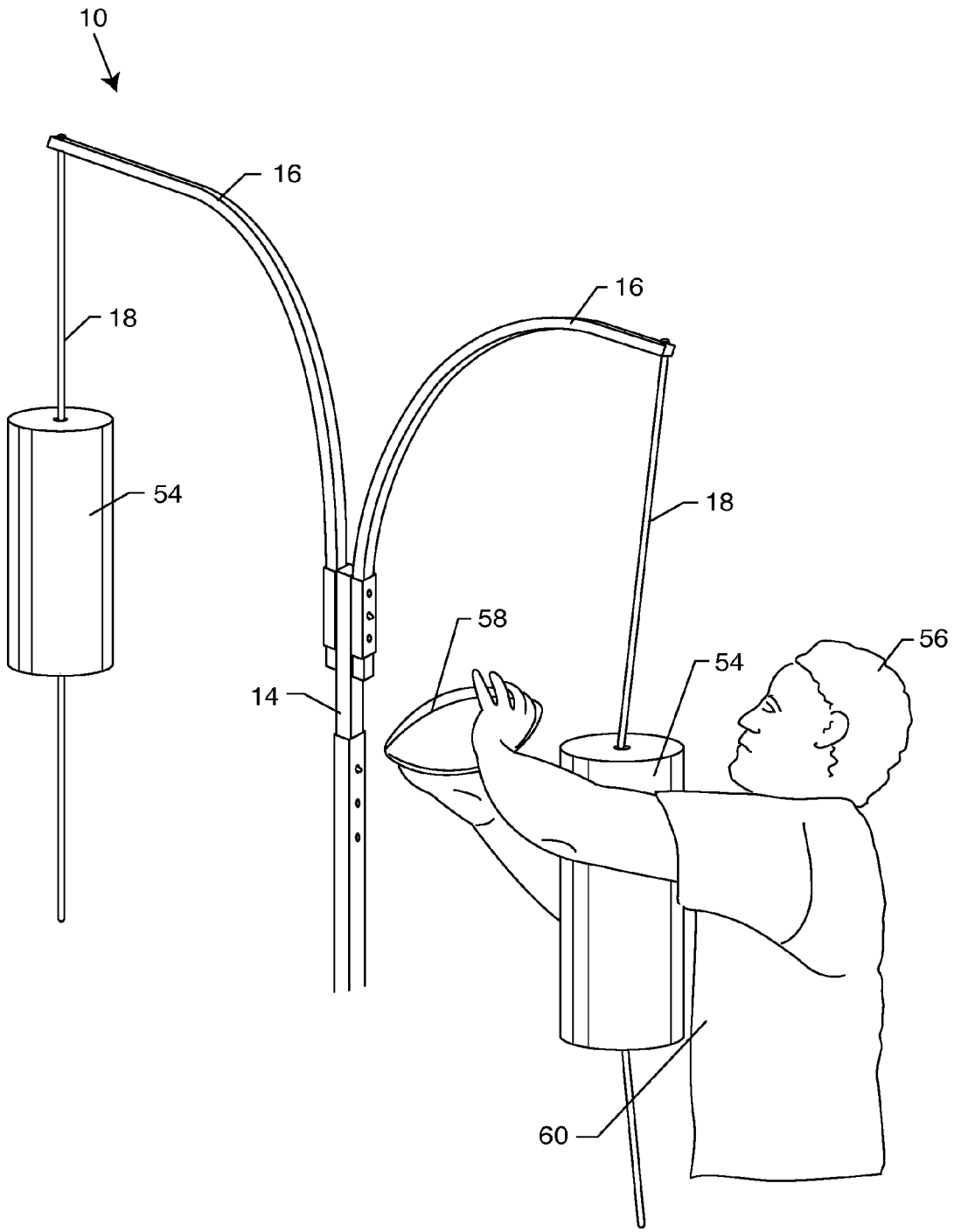
FIG. 5 is a perspective view of the football pass receiving trainer in use.

The bows 16 should be resiliently bendable in the manner generally shown in FIGS. 1, 2 and 5. FIG. 1 shows the interconnection of the bows 16 to any one of a plurality of feet 20. The connection of the cord 18 to the bows 16 is shown in FIG. 3 and connection of the cord 18 to the feet 20 is shown in FIG. 4. In FIG. 3, each bow 16 has a retainer 44 capable of receiving a hook 46 of the cord 18. Accordingly, the hook 46 is inserted into the retainer 44 to securely engage the cord 18 with the bow 16. An additional washer 48 may be disposed between the hook 46 and the bow 16 to facilitate engagement therebetween. Similarly, the cord 18 includes a lower hook 50 that engages a clip 52 formed at one end of the feet 20. Of course, the upper hook 46 and the lower hook 50 and the corresponding retainer 44 and clip 52 must be resilient enough to retain the cord 18 between the feet 20 and the bows 16. Furthermore, these components must be resilient enough to withstand substantial stretching of the cord 18 upon use of the football pass receiving trainer 10, as described below. Accordingly, the cord 18 may comprise a bungee cord, a dynamic rope or another elastic cord material (e.g. nylon or cotton) capable of stretching, absorbing shock and ultimately returning to an original, tensioned or unstretched size. Alternatively, the lower hook 50 may directly engage the feet 20 via any one of a plurality of apertures formed therein (not shown).

The football pass receiving trainer 10 is designed to be used in the manner shown generally in FIG. 5. A pad 54 disposed along the cord 18 prevents a receiver 56 from catching a football 58 close to a chest 60. A passer (not shown) throws the football 58 to one side of the pad 54, such as between the cord 18 and stem 14, as shown in FIG. 5. The receiver 56 extends around the exterior of the pad 54 to catch the football 58 while in flight. By the very nature of the pad 54 abutting the chest 60 of the receiver 56, the receiver 56 has no other choice than to catch the football 58 with the hands and extended arms and elbows. In this regard, the pad 54 also prevents the receiver 56 from catching the football 58 with elbows oriented toward the chest 60 of the receiver 56. Catching the football 58 with the hands and outstretched arms having elbows oriented generally away from the chest 60 is the preferable fundamental catching skills the receiver 56 should learn by using the football pass receiving trainer 10. Moreover, the football pass receiving trainer 10 also improves the hand-eye coordination of the receiver 56. As shown in FIG. 5, the cord 18 bends and stretches as the receiver 56 leans into the pad 54 to catch the football 58. The bow 16 may also stretch via its attachment with the cord 18. Hence, the football pass receiving trainer 10 is flexible and designed to provide some level of contact to the receiver 56. The pad 54 is adjustable in height along the length of the cord 18 for compatibility with receivers 56 of various heights. Preferably the pad 54 comprises foam, polyurethane, Styrofoam or other materials capable of withstanding and absorbing impact of the receiver 56, while not causing injury thereto. This further provides a game-like situation for the receiver practicing football reception skills.

Figure 9:
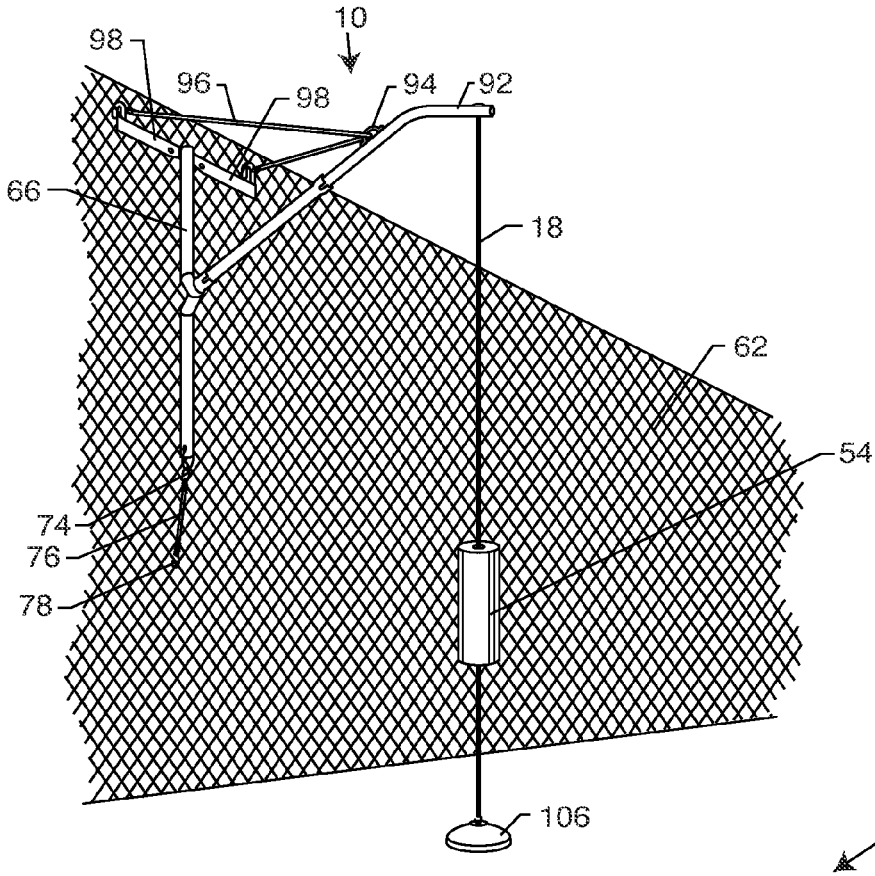
FIG. 9 is a perspective environmental view illustrating attachment of the alternative football pass receiving trainer of FIG. 6 to a chain link fence.
Figure 10:
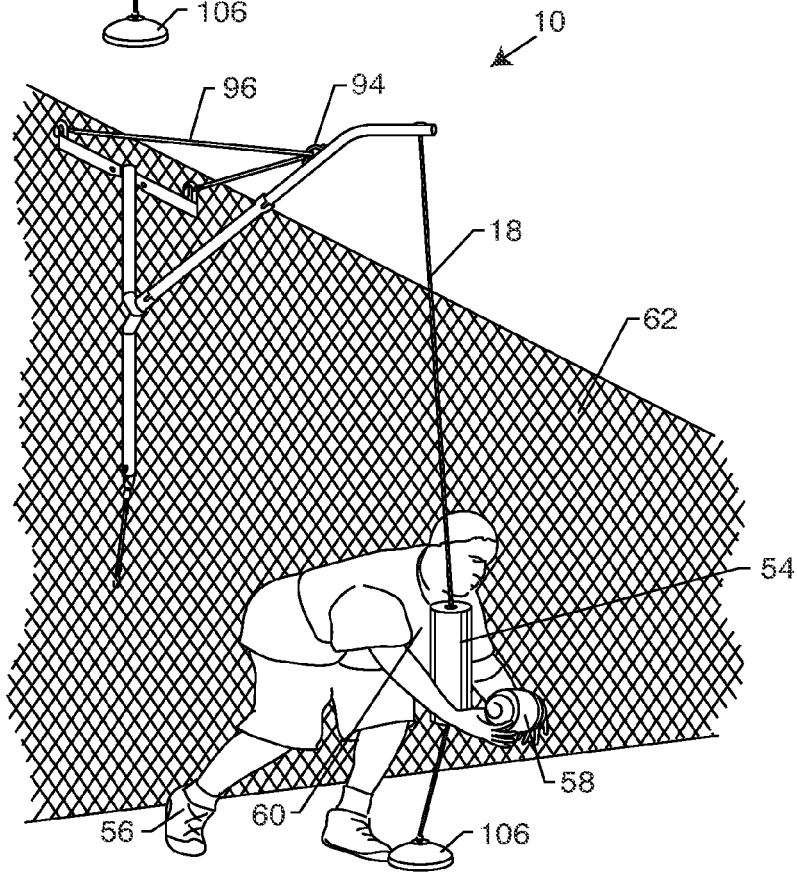
FIG. 10 is a perspective view illustrating the alternative football pass receiving trainer of FIG. 6 in use.

FIGS. 6-10 illustrate an alternative embodiment of the football pass receiving trainer 10. Here, the football pass receiving trainer 10 is specifically designed for attachment to a chain link fence 62 as generally shown in FIGS. 9 and 10. The football pass receiving trainer 10 attaches to the chain link fence 62 by a substantially rigid link hook 64 shown in FIG. 6. The link hook 64 engages any one of a plurality of the chains of the chain link fence 62 (FIGS. 9 and 10). The link hook 64 attaches to a main beam 66 by an attachment mechanism 68, such as a nut and bolt. The main beam 66 is a substantially rigid cylinder made from a metal, alloy or other rigid plastic material. An aperture 70 formed at a bottom 72 of the main beam 66 is configured to receive an upper hook 74 of a stabilizer cord 76. Preferably, the stabilizer cord 76 is manufactured from a material comparable to that of the cord 18, described above. The stabilizer cord 76 engages the aperture 70 via the upper hook 74 in accordance with the previous embodiments of the football pass receiving trainer 10. The stabilizer cord 76 stretches downwardly wherein the lower hook 78 engages any one of the chains on the chain link fence 62. Tensioning the stabilizer cord 76 provides a downward force on the link hook 64 and an upward force on the lower hook 78 to ensure stable attachment of the main beam 66 to the chain link fence 62. Accordingly, the link hook 64 and the lower hook 78 cannot be inadvertently dislodged from engagement with any of the chains on the chain link fence 62 during use of the football pass receiving trainer 10. Removal of the main beam 66 from the chain link fence 62 requires stretching the stabilizer cord 76 to disengage the lower hook 78 from the associated chain of the chain link fence 62. Once the lower hook 78 is disengaged, the link hook 64 may slide upwardly to disengage the relevant chain on the chain link fence 62.

The main beam 66 also includes an elbow 80 having a receptor 82 extending therefrom. The elbow 80 is angled in the form shown in FIG. 6 to provide maximum stability of the main beam 66 when the football pass receiving trainer 10 is used in accordance with the embodiments disclosed herein. A connector beam 84 has an engagement end 86 for interconnection with the receptor 82. The connector beam 84 also has a receptor end 88. The connector beam 84 may vary in length and functions to extend the football pass receiving trainer 10 away from the chain link fence 62 to provide adequate room to catch the football 58. Accordingly, the connector beam 84 engages an engagement end 90 of an extension beam 92. The extension beam 92 further extends away from the chain link fence 62 and attaches to the cord 18.

Figure 7:
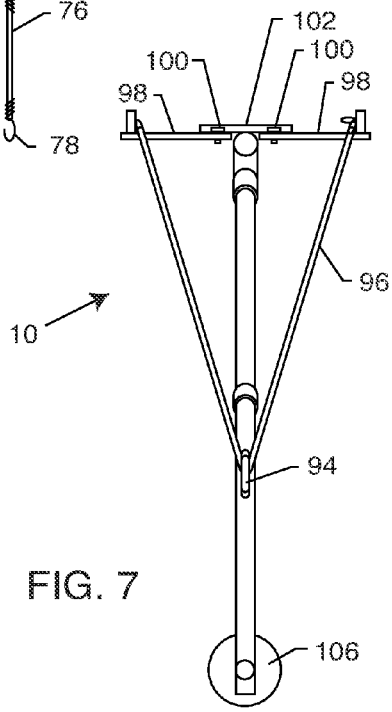
FIG. 7 is a top view of the alternative football pass receiving trainer of FIG. 6.
Figure 8:
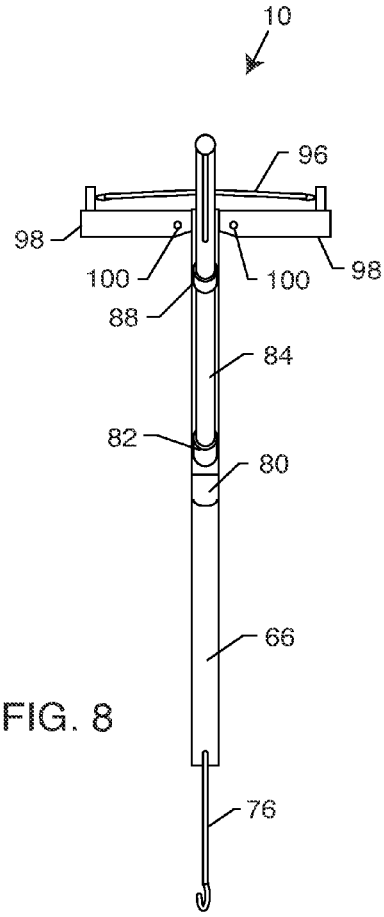
FIG. 8 is a front view of the alternative football pass receiving trainer of FIG. 6.

FIG. 7 shows a top view of the football pass receiving trainer 10 wherein the extension beam 92 includes a ring 94. Another cord 96 threads through the ring 94 and attaches to a chain on the chain link fence 62 in the manner shown in FIGS. 9 and 10. The cord 96 is similarly constructed out of materials comparable to the cord 18 and the stabilizer cord 76. When attached to the chain link fence 62, the cord 96 should be taut such that the engagement end 90 of the extension beam 92 compresses into the receptor end 88 of the connector beam 84. Likewise, the engagement end 86 of the connector beam 84 should sufficiently engage the receptor 82 protruding out from the elbow 80 of the main beam 66. Taut engagement of the cord 96 ensures that the extension beam 92, the connector beam 84 and the main beam 66 stay sufficiently engaged during use of the football pass receiving trainer 10. Preferably, the cord 96 is angled relative to the extension beam 92 as generally shown in FIGS. 7, 9 and 10. This triangular arrangement provides maximum stability of the football pass receiving trainer 10.

Additionally, a pair of stabilizing panels 98 prevent rotational movement of the football pass receiving trainer 10 when connected to the chain link fence 62. As shown in FIG. 7, the stabilizing panels 98 are pivotally connected to the main beam 66 by a pair of hinges 100. A mounting plate 102 rigidly attaches to a top portion 104 of the main beam 66 by any mechanism known in the art, such as by welding. The mounting plate 102 extends beyond the width of the main beam 66 as generally shown in the top view of FIG. 7. Accordingly, the stabilizing panels 98 pivotally engage to the mounting plate 102 via the hinges 100. The stabilizing panels 98 rotate about these hinges 100 to go from a perpendicular position, when attached to the chain link fence 62, to a substantially parallel position relative to the main beam 66 for storage or transportation. In an alternative embodiment, the cord 96 may rigidly attach directly to the stabilizing panels 98 instead of a chain on the chain link fence 62.

Figure 6:
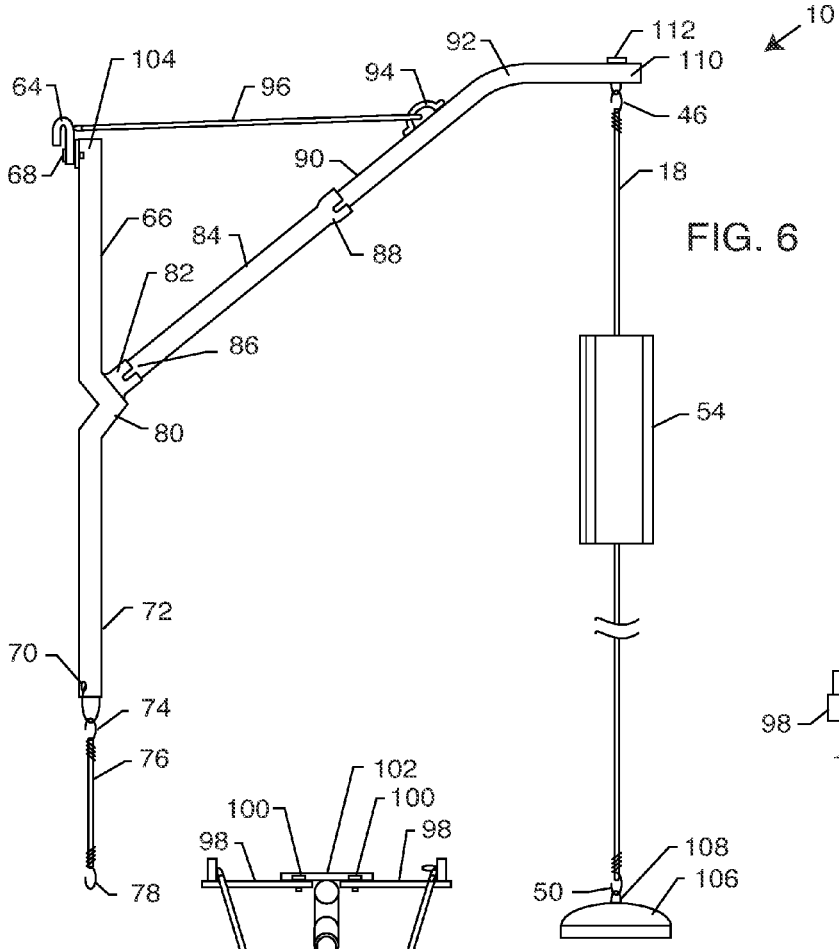
FIG. 6 is a side view of an alternative football pass receiving trainer attachable to a chain link fence.

The cord 18 secures to the ground by a base plate 106 as shown in FIG. 6. The base plate 106 includes a linkage 108 capable of receiving and attaching to a lower hook 50 of the cord 18. Accordingly, the upper hook 46 attaches to a front end 110 of the extension beam 92 via an attachment device 112. The attachment device 112 may comprise anything known in the art for retaining the upper hook 46, including any of the previously described embodiments. The cord 18 is maintained in the substantially upright position between the extension beam 92 and the base plate 106. The base plate 106 is sufficiently weighted to prevent movement thereof when the football pass receiving trainer 10 is used as generally shown in FIG. 10. Alternatively, the base plate 106 may secure to the ground by stakes or other methods known in the art. Accordingly, the pad 54 may adjust anywhere along the vertical height of the cord 18 depending on the receiving exercise performed by the receiver 56. For example, in FIG. 10 the receiver 56 receives the football 58 in a crouched position. Accordingly, the pad 54 is in a position on the cord 18 that is relatively lower than the position of the pad 54 in FIG. 5. The pad 54 is selectively detachable from the cord 18 and may be formed from a variety of shapes or sizes corresponding to the specific user. A smaller diameter pad 54 may be used for receivers having shorter arms, while a larger diameter pad 54 may be used for receivers 56 having longer arms. Again, the purpose of the football pass receiving trainer 10 is to force the receiver 56 to catch the football 58 with the hands and extended arms, thereby simultaneously preventing the receiver 56 from catching the football 58 with the chest 60. Accordingly, the football pass receiving trainer 10 promotes the fundamental skills of catching the football 58 with the hands and having arms and elbows extended away from the chest 60, all while improving hand-eye coordination.

Although several embodiments have been described in some detail for purposes of illustration, various modifications may be made to each without departing from the scope and spirit of the invention. Accordingly, the invention is not to be limited, except as by the appended claims.

What is claimed is:

1. A football pass receiving trainer for encouraging a receiver to catch a football with the hands and with extended arms and elbows, the trainer comprising:

a generally vertical elastic cord having a lower end fixed to a lower support;

an upper support having an extension beam or bow to which an upper end of the cord is fixed; and a generally cylindrical pad selectively slidably positionable along the length of the cord, the pad configured to require the receiver, when standing on one side of the pad, to catch an airborne football on an opposite side of the pad with the receiver's hands, and with the receiver's arms and elbows extended.

2. The trainer of claim 1, wherein the extension beam or bow is selectively positionable relative to the lower support.

3. The trainer of claim 2, wherein the upper support includes a stem to which the bow is fixed.

4. The trainer of claim 3, including a base to which the upper support and the lower support are fixed.

5. The trainer of claim 4, wherein the lower support comprises at least one foot extending from the base.

6. The trainer of claim 1, wherein the lower support is ground-engaging.

7. The trainer of claim 1, including hook associated with the upper support and configured for selective engagement with a link on a fence.

8. The trainer of claim 7, including a second cord coupled to the first support and selectively engageable with another link on the fence, wherein the second cord and the hook cooperate to selectively secure the first support to the fence.

9. The trainer of claim 1, including a panel associated with the first support and selectively positionable between retracted and extended positions.

* * * * *